US005950663A

United States Patent [19]

Bloomfield

[11] Patent Number: 5,950,663

[45] Date of Patent: Sep. 14, 1999

[54] FAUCET INSTALLATION SYSTEM

[76] Inventor: Terence M. Bloomfield, 17C The Street, Shorne, Gravesend Kent DA12 3EA, United Kingdom

[21] Appl. No.: 09/036,417

[22] Filed: Mar. 5, 1998

[51] Int. Cl.[6] ..... E03C 1/04

[52] U.S. Cl. ..... 137/359; 137/606; 137/801; 285/206

[58] Field of Search ..... 4/676, 678; 137/359, 137/606, 801; 285/404, 206

[56] References Cited

U.S. PATENT DOCUMENTS

| | | | |
|---|---|---|---|
| 2,997,058 | 8/1961 | Hall | 137/360 |
| 3,025,085 | 3/1962 | Young | 137/360 X |
| 3,136,570 | 6/1964 | Lee | 137/360 X |
| 3,392,746 | 7/1968 | Young | 137/360 |
| 3,640,305 | 2/1972 | Young | 137/360 |
| 3,760,836 | 9/1973 | Albanese | 137/360 |
| 4,262,699 | 4/1981 | Fabian | 137/801 |
| 4,848,395 | 7/1989 | Krippendorf | 137/359 |
| 5,685,341 | 11/1997 | Chrysler et al. | 137/801 |

*Primary Examiner*—Gerald A. Michalsky

[57] ABSTRACT

A faucet installation system is provided including at least one base assembly coupled to a water source and having an upper extent fixedly coupled to and extending from an aperture formed in a sink. The upper extent has an O-ring formed thereon. A faucet is provided having an inlet bore formed therein for releasably receiving the upper extent in a sealed manner for receiving water therefrom.

6 Claims, 5 Drawing Sheets

23
14
16
17
18
26
28
20
25
22
24
30

FAUCET INSTALLATION SYSTEM

BACKGROUND OF THE INVENTION

1. Field of the Invention

The present invention relates to faucet installation apparatuses and more particularly pertains to a new faucet installation system for allowing the immediate installation of a faucet base assembly and further the selection and convenient installation of a desired faucet at a later time.

2. Description of the Prior Art

The use of faucet installation apparatuses is known in the prior art. More specifically, faucet installation apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art faucet installation apparatuses include U.S. Pat. No. 5,010,922; U.S. Pat. No. 4,781,399; U.S. Pat. No. 5,143,346; U.S. Pat. No. 4,281,857; U.S. Pat. No. 4,655,486; and U.S. Pat. Des. 243,488.

In these respects, the faucet installation system according to the present invention substantially departs from the conventional concepts and designs of the prior art, and in so doing provides an apparatus primarily developed for the purpose of allowing the installation of a faucet base assembly and the selection and convenient installation of a desired faucet at different times.

SUMMARY OF THE INVENTION

In view of the foregoing disadvantages inherent in the known types of faucet installation apparatuses now present in the prior art, the present invention provides a new faucet installation system construction wherein the same can be utilized for allowing the installation of a faucet base assembly and selection and convenient installation of a desired faucet at different times.

The general purpose of the present invention, which will be described subsequently in greater detail, is to provide a new faucet installation system apparatus and method which has many of the advantages of the faucet installation apparatuses mentioned heretofore and many novel features that result in a new faucet installation system which is not anticipated, rendered obvious, suggested, or even implied by any of the prior art faucet installation apparatuses, either alone or in any combination thereof.

To attain this, the present invention generally comprises a template having a planar rectangular configuration. A pair of spaced circular apertures are formed in the template for boring a pair of properly spaced apertures in a sink. Next provided is a pair of base assemblies. Each base assembly includes an upper extent having a hollow generally cylindrical configuration with an open top end, an open bottom end and a periphery formed therebetween. The periphery is tapered adjacent to the open top end. The periphery further has a first O-ring mounted thereon adjacent to the open top end. A planar annular flange is mounted to a central extent thereof and extended radially therefrom, as best shown in FIG. 3. A plurality of threaded grooves is formed in the upper extent below the annular flange. A second O-ring is mounted on the upper extent between the open bottom end and the threaded grooves. During use, the upper extent is situated in an associated one of the apertures of the sink such that the flange rests on an upper surface of the sink. A first planar annular elastomeric bushing is situated about the upper extent between the annular flange thereof and the sink for sealing purposes. With reference still to FIG. 3, it is shown that each base assembly includes a lower extent having a sleeve with threaded interior. A planar annular flange is coupled to a top end of the lower extent and extends radially therefrom. The lower extent is screwably coupled to the upper extent such that the annular flange of the lower extent abuts a lower surface of the sink. Finally, a second planar annular elastomeric bushing is situated about the upper extent between the annular flange of the lower extent and the sink for sealing purposes. Note FIG. 6. Also included is a pair of flexible tubes each having an upper end with a threaded exterior surface for coupling with the lower extent of the corresponding base assembly. A bottom end of the flexible tubes are each equipped with a threaded interior surface for coupling with a water source. The bottom end has a valve situated therein. As shown in FIG. 9, the valve includes a sphere rotatably mounted therein with a diametrically oriented bore formed therein. At least a portion of the sphere extends from the tube with a screw adapter which is adapted to allow the rotation of the sphere to selectively preclude the passage of water therethrough. Finally, a faucet is provided having an outlet and a pair of inlet bores formed in a bottom face thereof for releasably and sealingly receiving the upper extents of the base assemblies. The faucet further includes a pair of threaded bores formed therein and extended radially from an associated one of the inlet bores. The threaded bores serve for screwably receiving a set screw which secures the faucet to the upper extents of the base assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new faucet installation system apparatus and method which has many of the advantages of the faucet installation apparatuses mentioned heretofore and many novel features that result in a new faucet installation system which is not anticipated, rendered obvious, suggested, or even implied by any of the prior art faucet installation apparatuses, either alone or in any combination thereof.

It is another object of the present invention to provide a new faucet installation system which may be easily and efficiently manufactured and marketed.

It is a further object of the present invention to provide a new faucet installation system which is of a durable and reliable construction.

An even further object of the present invention is to provide a new faucet installation system which is susceptible of a low cost of manufacture with regard to both materials and labor, and which accordingly is then susceptible of low prices of sale to the consuming public, thereby making such faucet installation system economically available to the buying public.

Still yet another object of the present invention is to provide a new faucet installation system which provides in the apparatuses and methods of the prior art some of the advantages thereof, while simultaneously overcoming some of the disadvantages normally associated therewith.

Still another object of the present invention is to provide a new faucet installation system for allowing the installation of a faucet base assembly and selection and convenient installation of a desired faucet at different times.

Even still another object of the present invention is to provide a new faucet installation system that includes at least one base assembly coupled to a water source and having an upper extent fixedly coupled to and extending from an aperture formed in a sink. The upper extent has an O-ring formed thereon. A faucet is provided having an inlet bore formed therein for releasably receiving the upper extent in a sealed manner for receiving water therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be in made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
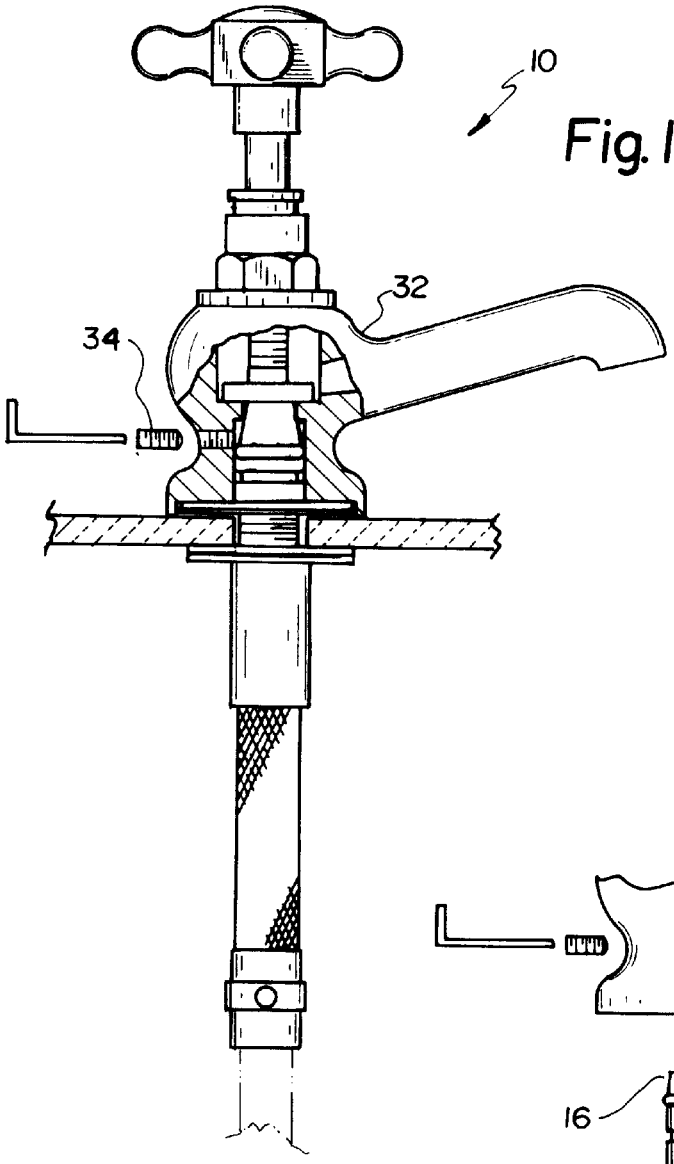
FIG. 1 is a side cross-sectional view of a new faucet installation system according to the present invention.
Figure 2:
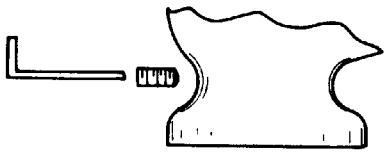
FIG. 2 is a side cross-sectional view of solely the base assembly and flexible tube of the present invention.
Figure 2:
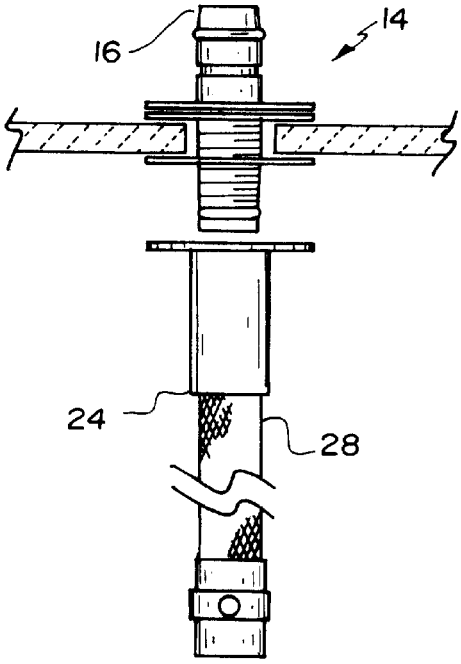

With reference now to the drawings, and in particular to FIGS. 1 through 9 thereof, a new faucet installation system embodying the principles and concepts of the present invention and generally designated by the reference numeral 10 will be described.

The present invention, designated as numeral 10, includes a template 12 having a planar rectangular configuration. A pair of spaced circular apertures are formed in the template for boring a pair of properly spaced apertures in a sink or bath.

Next provided is a pair of base assemblies 14. Each base assembly includes an upper extent 16 having a hollow generally cylindrical configuration with an open top end, an open bottom end and a periphery formed therebetween. The periphery is tapered adjacent to the open top end. The periphery further has a first O-ring 17 mounted thereon adjacent to the open top end. A planar annular flange 18 is mounted to a central extent thereof and extended radially therefrom, as best shown in FIG. 3.

A plurality of threaded grooves 20 is formed in the upper extent below the annular flange. A second O-ring 22 is mounted on the upper extent between the open bottom end and the threaded grooves. During use, the upper extent is situated in an associated one of the apertures of the sink such that the flange rests on an upper surface of the sink. Note FIG. 6. A first planar annular elastomeric bushing 23 is situated about the upper extent between the annular flange thereof and the sink for sealing purposes.

Figure 3:
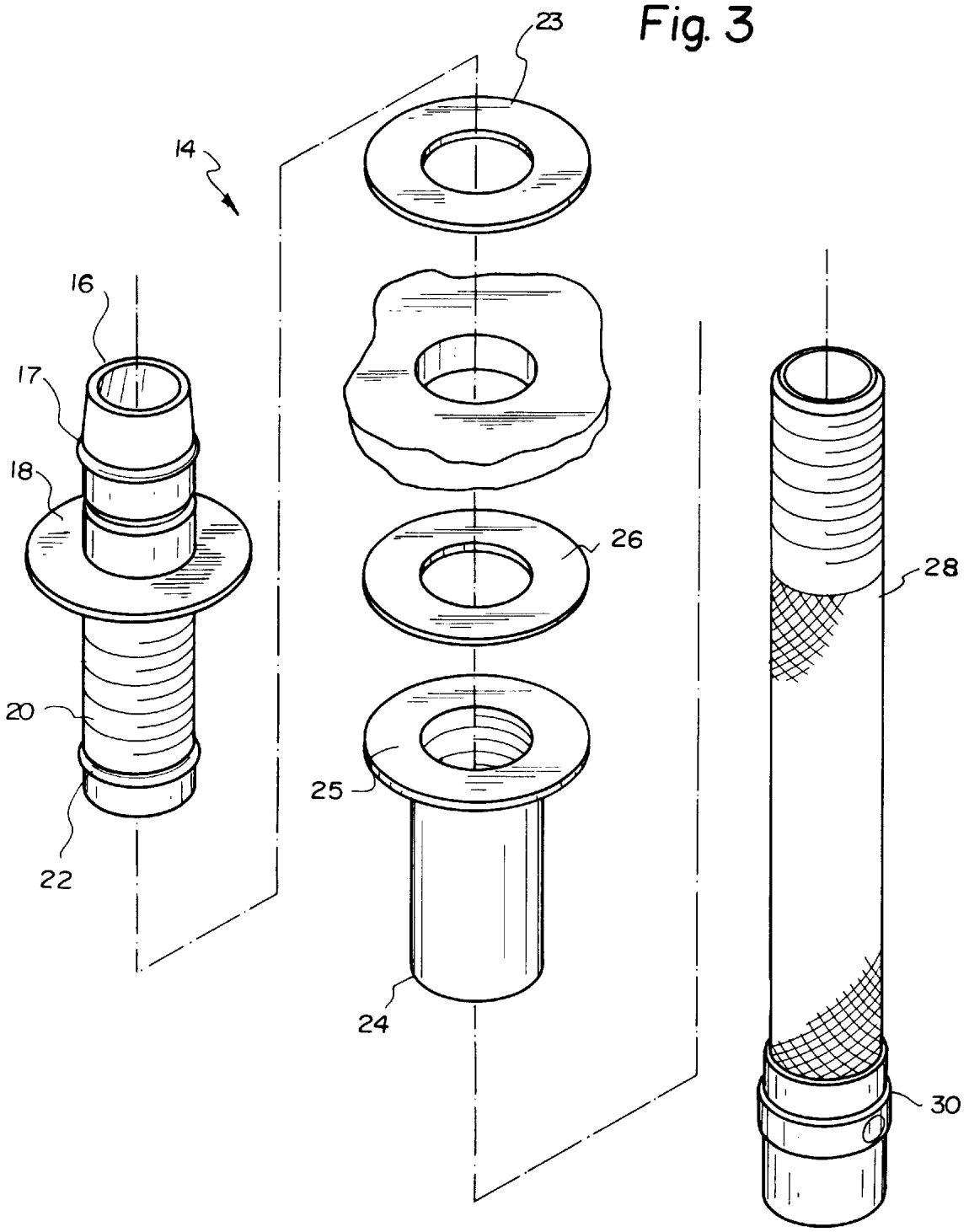
FIG. 3 is an exploded view of the present invention.
Figure 4:
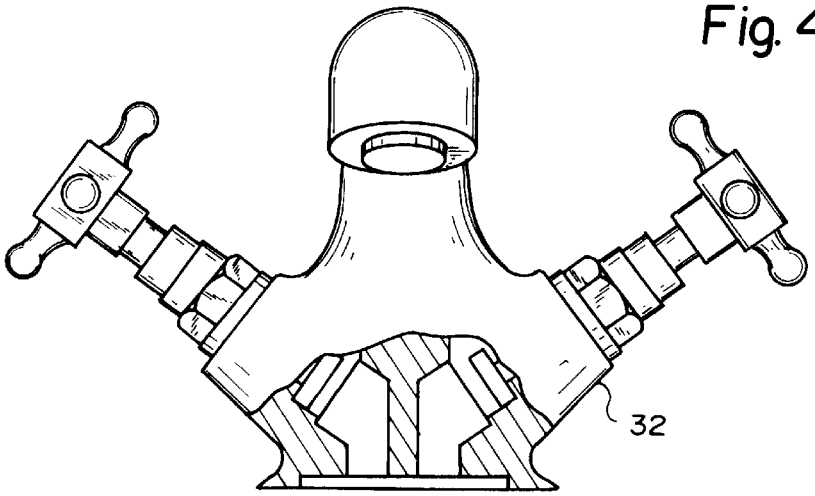
FIG. 4 is a front view of an alternate embodiment of the present invention.
Figure 4:
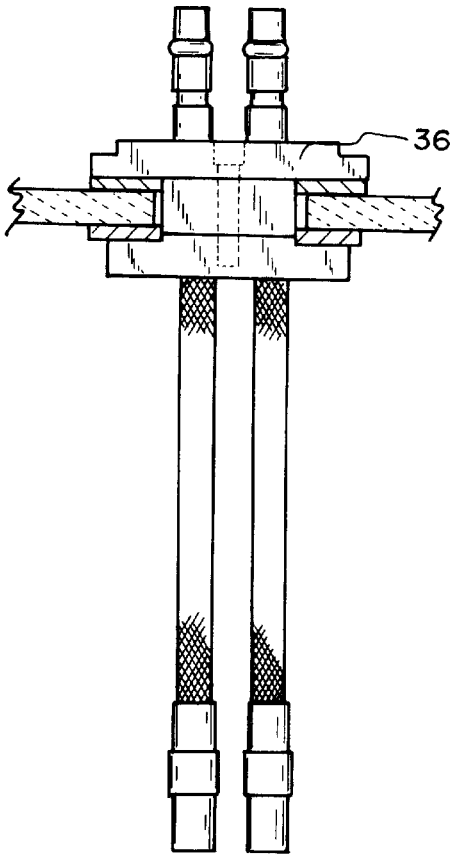
Figure 5:
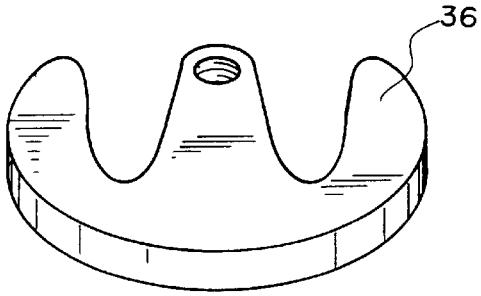
FIG. 5 is a perspective view of the alternate embodiment of the present invention.
Figure 6:
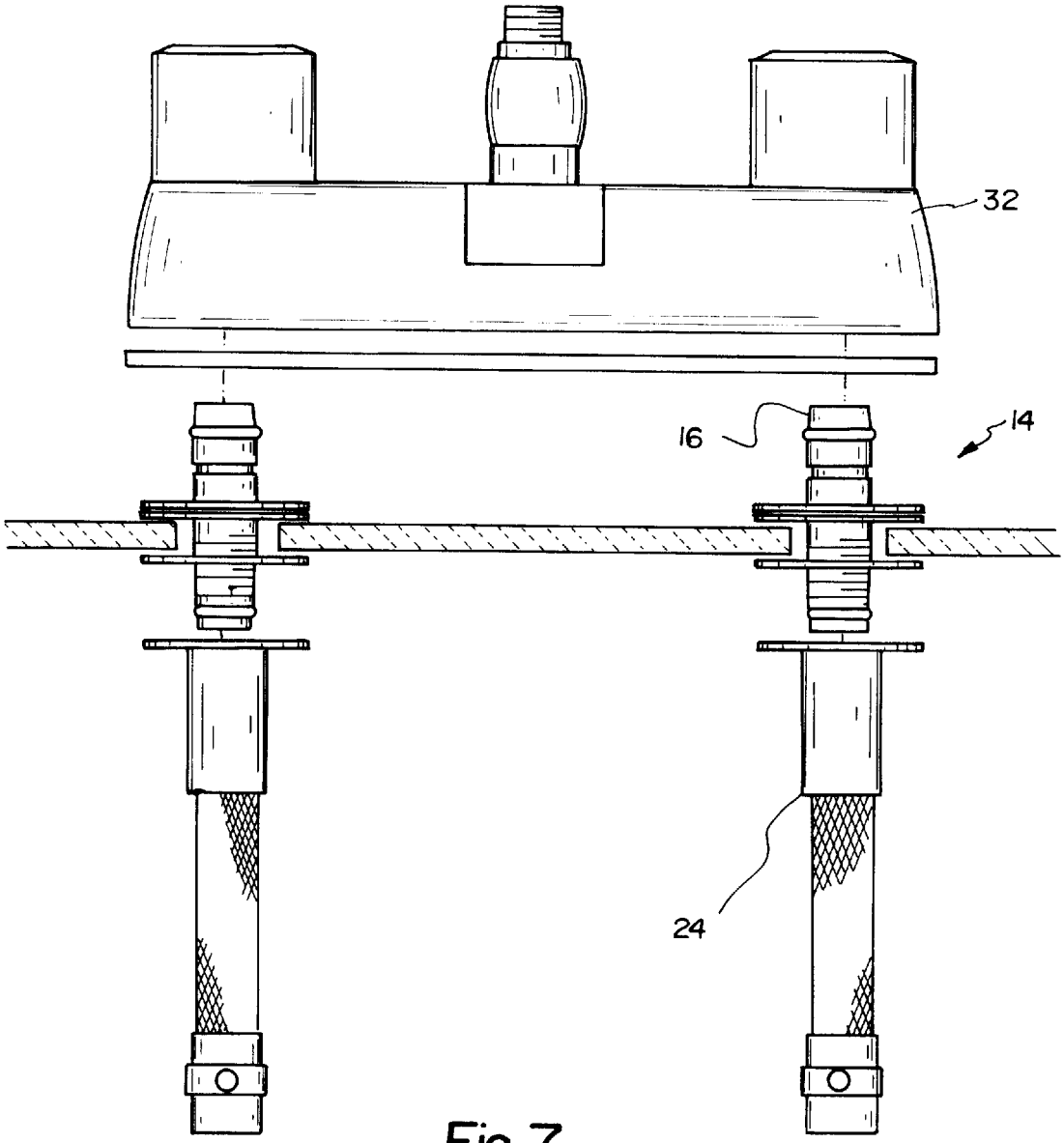
FIG. 6 is a front view of the present invention.
Figure 7:
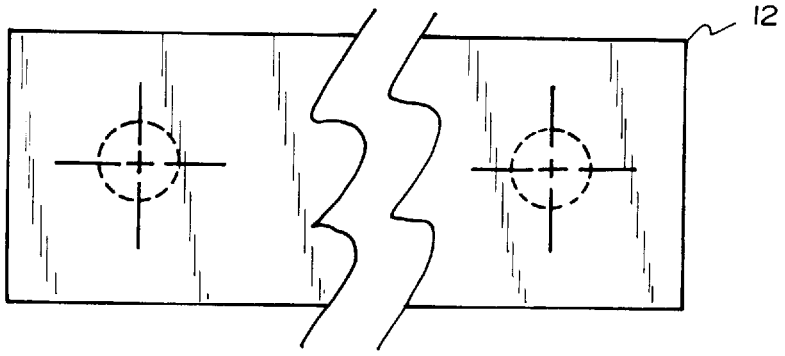
FIG. 7 is a top view of the template of the present invention.
Figure 8:
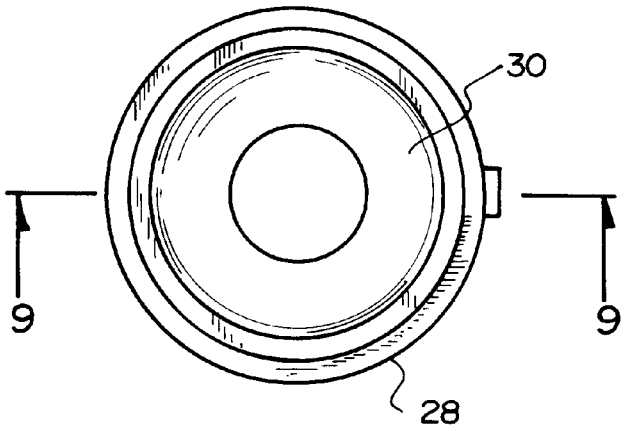
FIG. 8 is a top view of the ball valve and flexible tube of the present invention.

With reference still to FIG. 3, it is shown that each base assembly further includes a lower extent 24 defined by a sleeve with threaded interior. A planar annular flange 25 is coupled to a top end of the lower extent and extends radially therefrom. The lower extent is screwably coupled to the upper extent such that the annular flange of the lower extent abuts a lower surface of the sink. It should be noted that an inner surface of the upper extent is adapted to receive an Allen wrench to facilitate such screwable coupling. Finally, each base assembly includes a second planar annular elastomeric bushing 26 situated about the upper extent between the annular flange of the lower extent and the sink for sealing purposes. Note FIG. 6.

Figure 9:
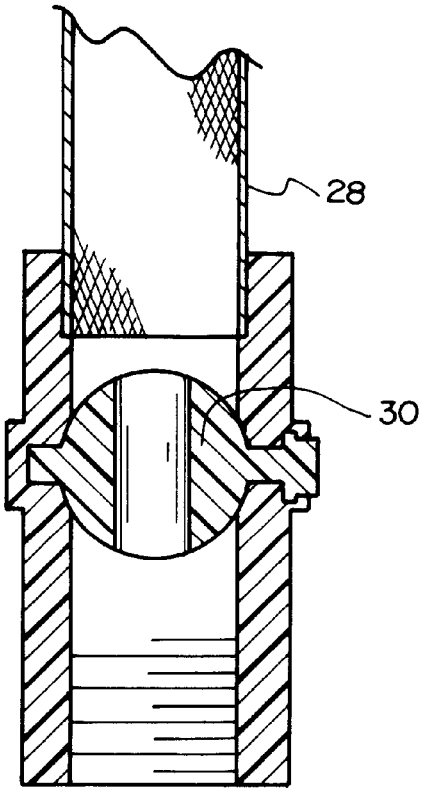
FIG. 9 is a side cross-sectional view of the ball valve taken along line 9—9 of FIG. 8.

Also included is a pair of flexible tubes 28 each having an upper end with a threaded exterior surface for coupling with the lower extent of the corresponding base assembly. A bottom end of the flexible tubes are each equipped with a threaded interior surface for coupling with a water source. The bottom end has a valve 30 situated therein. As shown in FIG. 9, the valve includes a sphere rotatably mounted therein with a diametrically oriented bore. At least a portion of the sphere extends from the tube with a screw adapter. Such adapter serves to allow the rotation of the sphere via a screwdriver to selectively preclude the passage of water through the tube.

Finally, a faucet 32 is provided having an outlet and a pair of smooth inlet bores formed in a bottom face thereof for releasably and sealingly receiving the upper extents of the base assemblies. The faucet further includes a pair of threaded bores formed therein and each extended radially from an associated one of the inlet bores. The threaded bores serve for screwably receiving a set screw 34 which secures the faucet to the upper extents of the base assemblies.

As is apparent from the various Figures, a single base assembly and tube may be employed with a faucet having a single inlet bore. In such embodiment, the need for the template is obviated. In yet another alternate embodiment, the base assemblies may be situated through a common hole and maintained in the proper relationship via a pair of washers 36 each with a pair of U-shaped cut outs formed therein. Note FIG. 5. Such washers are maintained both above and below the sink via a bolt which is rotatable by way of an Allen wrench.

During use, the base assembly or assemblies are mounted to the sink and the valve is closed for allowing the selection and convenient installation of a desired faucet at a later time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and used, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalents may be resorted to, falling within the scope of the invention.

I claim:

1. A two-step faucet installation system comprising, in combination:

a template having a planar rectangular configuration with a pair of spaced circular apertures formed thereon for boring a pair of properly spaced apertures in a sink;

a pair of base assemblies each comprising:

an upper extent having a hollow generally cylindrical configuration with an open top end, an open bottom end and a periphery formed therebetween, the periphery being tapered adjacent to the open top end, the periphery having a first O-ring mounted thereon adjacent to the open top end, a planar annular flange mounted to a central extent thereof and extending radially therefrom, a plurality of threaded grooves formed therein below the annular flange, and a second O-ring mounted thereon between the open bottom end and the threaded grooves, wherein the upper extent is situated in an associated one of the apertures of the sink such that the flange rests on an upper surface of the sink, a first planar annular elastomeric bushing situated about the upper extent between the annular flange thereof and the sink for sealing purposes, a lower extent including a sleeve with threaded interior and a planar annular flange coupled to a top end of the lower extent and extending radially therefrom, the lower extent screwably coupled to the upper extent such that the annular flange of the lower extent abuts a lower surface of the sink, and a second planar annular elastomeric bushing situated about the upper extent between the annular flange of the lower extent and the sink for sealing purposes;

a pair of flexible tubes each including an upper end with a threaded exterior surface for coupling with the lower extent of the corresponding base assembly and a bottom end with a threaded interior surface for coupling with a water source, the bottom end having a valve situated therein, the valve including a sphere rotatably mounted therein with a diametrically oriented bore formed therein, wherein at least a portion of the sphere extends from the tube with a screw adapter formed therein which is adapted to allow the rotation of the sphere to selectively preclude the passage of water therethrough; and a faucet having an outlet and a pair of inlet bores formed in a bottom face thereof for releasably and sealingly receiving the upper extents of the base assemblies, the faucet further including a pair of threaded bores formed therein and extending radially from an associated one of the inlet bores for screwably receiving a set screw which secures the faucet to the upper extents of the base assemblies.

2. A two-step faucet installation system comprising:

a sink having a pair of apertures therethrough;

a pair of base assemblies each comprising:

a tubular upper extent having open top and bottom ends, and an outer periphery formed therebetween;

the outer periphery of the upper extent being tapered adjacent to the open top end of the upper extent;

the outer periphery of the upper extent having a first O-ring mounted thereon adjacent to the open top end of the upper extent;

the upper extent having an outwardly radiating annular flange;

the upper extent having a plurality of threaded grooves formed thereon between the annular flange and the open bottom end of the upper extent;

a second O-ring being mounted on the upper extent between the open bottom end and the threaded grooves of the upper extent;

the upper extent being extended through an associated one of the apertures of the sink such that the annular flange of the upper extent rests on an upper surface of the sink, a first annular elastomeric bushing being disposed around the upper extent between the annular flange of the upper extent and the sink for providing a seal between the sink and the upper extent;

a lower extent having open top and bottom ends, a tubular sleeve having a threaded lumen, and an annular flange outwardly radiating from the top end of the lower extent;

the upper extent being threadably inserted into top end of the lower extent such that the annular flange of the lower extent abuts a lower surface of the sink;

a second annular elastomeric bushing being disposed around the upper extent and positioned between the lower surface of the sink and the annular flange of the lower extent for providing a seal between the sink and the lower extent;

a pair of flexible tubes each having opposite open upper and lower ends, the upper end of each flexible tube being coupled to the bottom end of an associated lower extent to fluidly connect each flexible tube to the associated lower extent;

the lower ends of the flexible tubes being adapted for fluidly connecting to a water supply;

the lower ends of each flexible tube having a valve therein, the valve having a sphere rotatably mounted therein, the sphere having a diametrically oriented bore formed therein;

a portion of the sphere being extended from the respective flexible tube, the portion of the sphere having a screw adapter formed therein for allowing the rotation of the sphere to selectively preclude the passage of water therethrough; and a faucet having an outlet and a pair of inlet bores formed in a bottom face thereof, the inlets bores of the faucet releasably and sealingly receiving the upper extents of the base assemblies therein; and the faucet having a pair of threaded bores formed therein and extending radially from an associated one of the inlet bores for screwably receiving a set screw which secures the faucet to the upper extents of the base assemblies.

3. A faucet connector for extending through hole in a sink and fluidly connecting a faucet mounted on the sink to a water supply, said faucet connector comprising:

a tubular upper extent having open upper and lower ends;

said upper end of said upper extent being adapted for fluidly connecting to a faucet;

said lower end of said upper extent being adapted for downwardly extending through a hole in a sink;

a pair of O-rings being disposed around said upper extent;

said upper extent having an annular flange outwardly radiating therefrom, said annular flange of said upper extent being positioned between said first and second O-rings;

a tubular lower extent having open top and bottom ends;

said lower extent having an annular flange outwardly radiating from said top end of said lower extent;

said lower end of said upper extent being inserted into said top end of said lower extent;

said lower extent being adapted for fluidly connecting to a water supply; and a pair of elastomeric annular bushings being disposed around said upper extent and positioned between said annular flanges of said upper and lower extents.

4. The faucet connector of claim 3, wherein said upper extent has a threaded exterior portion interposed between said annular flange of said upper extent and one O-ring of said pair of said O-rings located adjacent said lower end of said upper extent, wherein said lower extent has a threaded lumen, and wherein said threaded exterior portion of said upper extent threadably engages said threaded lumen of said lower extent.

5. The faucet connector of claim 4, further comprising an elongate flexible tube having opposite open upper and lower ends, wherein said upper end of said flexible tube is inserted into said bottom end of said lower extent to fluidly connect said flexible tube to said lower extent, and wherein said lower end of said flexible tube is adapted for fluidly connecting to a water supply.

6. The faucet connector of claim 5, wherein said flexible tube has an upper threaded exterior portion adjacent said upper end of said flexible tube, wherein said upper threaded exterior portion of said flexible tube threadably engages said threaded lumen of said lower extent.

* * * * *